US012076656B2

(12) United States Patent
Braun et al.

(10) Patent No.: US 12,076,656 B2
(45) Date of Patent: Sep. 3, 2024

(54) SLIDE, IN PARTICULAR WATER SLIDE

(71) Applicant: Aquarena Holding GmbH, Jettingen (DE)

(72) Inventors: Rainer Braun, Magstadt (DE); Florian Zebisch, Heubach-Lautern (DE)

(73) Assignee: AQUARENA HOLDING GMBH, Jettingen (DE)

( * ) Notice: Subject to any disclaimer, the term of this patent is extended or adjusted under 35 U.S.C. 154(b) by 159 days.

(21) Appl. No.: 17/703,532

(22) Filed: Mar. 24, 2022

(65) Prior Publication Data

US 2022/0305393 A1 Sep. 29, 2022

(30) Foreign Application Priority Data

Mar. 25, 2021 (DE) ..... 102021107558.0

(51) Int. Cl.
*A63G 21/18* (2006.01)

(52) U.S. Cl.
CPC ..... *A63G 21/18* (2013.01)

(58) Field of Classification Search
None
See application file for complete search history.

(56) References Cited

U.S. PATENT DOCUMENTS 3,556,604 A 1/1971 Round
4,196,900 A * 4/1980 Becker ..... A63G 21/00 472/117
4,578,188 A 3/1986 Cousino
5,213,547 A 5/1993 Lochtefeld
5,322,387 A 6/1994 Heine et al.
6,450,891 B1 * 9/2002 Dubeta ..... A63G 21/18 472/117
6,743,107 B2 * 6/2004 Dubeta ..... A63G 21/18 472/117
6,743,108 B2 * 6/2004 Hunter ..... A63G 21/18 472/117
7,854,662 B2 12/2010 Braun et al.
(Continued)

FOREIGN PATENT DOCUMENTS

CN 108310778 A * 7/2018 ..... A63G 21/04
CN 113897909 A * 1/2022
(Continued)

*Primary Examiner* — Joseph A Dillon, Jr.
(74) *Attorney, Agent, or Firm* — KRIEGSMAN & KRIEGSMAN

(57) ABSTRACT

Slide, in particular a water slide, with a take-off zone and a landing zone, between which at least one slide path with a slide surface extends, which includes a run-up section leading away from the take-off zone and a run-out section leading into the landing zone, with a plurality of slide sections of the slide path provided between the run-up and run-out sections, with at least one branching section arranged in the slide path, by which branching section an incoming slide section is divided into a plurality of outgoing slide sections or a plurality of incoming slide sections are combined into one outgoing slide section, wherein the branching section has a first slide connector and, adjacently thereto, a second slide connector, both of which are opposite or remote from a third slide connector. A mouth region is formed between the first and second slide connector and the third slide connector.

15 Claims, 5 Drawing Sheets

(56) References Cited

U.S. PATENT DOCUMENTS

Figure 1:
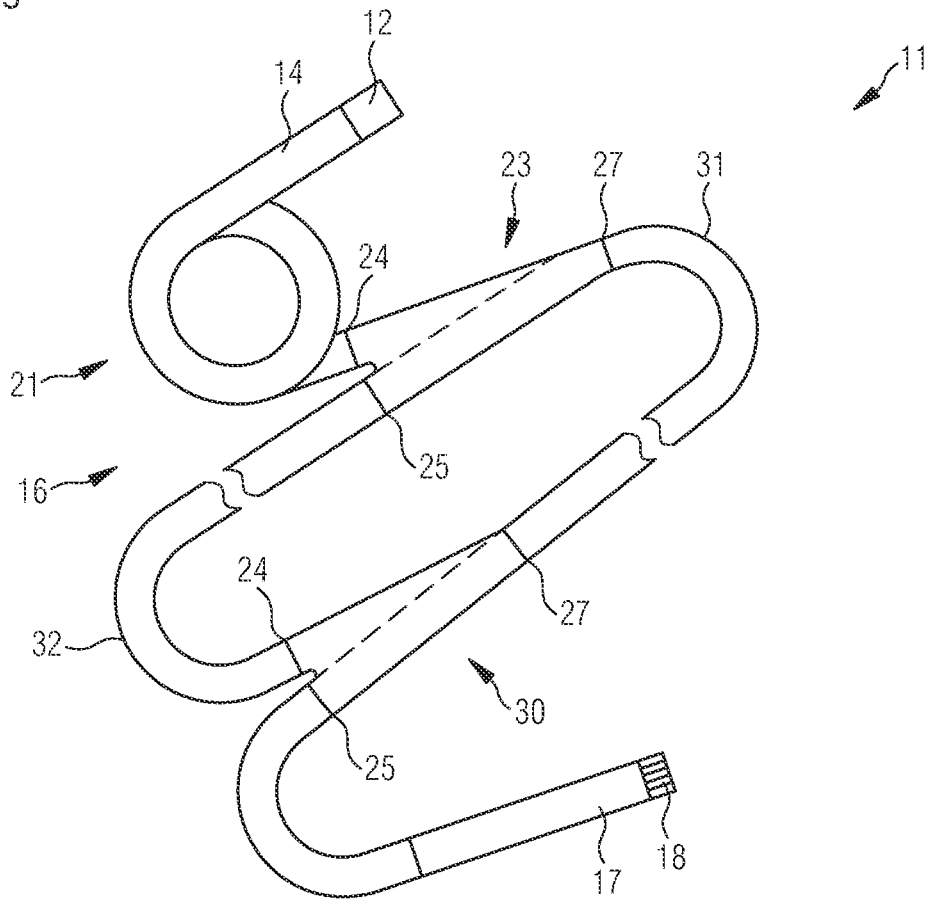

| | | | | |
|---|---|---|---|---|
| 8,733,400 | B2 | 5/2014 | Muggli et al. | |
| 9,533,232 | B2 | 1/2017 | Braun | |
| 11,090,571 | B2 | 8/2021 | Hunter et al. | |
| 2002/0142851 | A1 | 10/2002 | Hunter | |
| 2005/0047869 | A1 | 3/2005 | Lochtefeld | |
| 2005/0075180 | A1 | 4/2005 | Dubeta | |
| 2005/0288112 | A1* | 12/2005 | Hunter | A63G 21/18 472/117 |
| 2007/0049385 | A1* | 3/2007 | Henry | A63G 3/00 472/117 |
| 2008/0153610 | A1* | 6/2008 | Braun | A63G 21/18 472/117 |
| 2011/0177872 | A1* | 7/2011 | Hunter | A63G 21/18 472/117 |
| 2011/0183768 | A1* | 7/2011 | Olive | A63G 21/18 472/117 |
| 2012/0190465 | A1* | 7/2012 | Hunter | A63G 21/18 472/117 |
| 2012/0258812 | A1 | 10/2012 | Osterman et al. | |
| 2013/0184087 | A1* | 7/2013 | Degirmenci | A63G 21/04 472/117 |
| 2015/0045128 | A1* | 2/2015 | Fischer | A63G 21/10 472/116 |
| 2015/0045129 | A1* | 2/2015 | Brassard | A63G 21/18 472/117 |
| 2017/0106295 | A1* | 4/2017 | Hunter | A63G 21/10 |
| 2018/0036643 | A1* | 2/2018 | Klarer | A63G 31/007 |
| 2019/0143226 | A1* | 5/2019 | Briggs | A63G 21/18 472/117 |
| 2020/0215441 | A1* | 7/2020 | Ozturk | A63G 21/18 |
| 2020/0222818 | A1* | 7/2020 | Chutter | A63G 21/18 |
| 2022/0305394 | A1* | 9/2022 | Braun | A63G 21/18 |
| 2023/0113886 | A1* | 4/2023 | Jenson | A63G 21/10 472/116 |
| 2023/0277949 | A1* | 9/2023 | Hunter | A63G 21/18 472/117 |

FOREIGN PATENT DOCUMENTS

| | | | | |
|---|---|---|---|---|
| DE | 202007014719 | U1 | 7/2008 | |
| WO | WO-2013066155 | A1 * | 5/2013 | A63G 21/14 |

* cited by examiner

SLIDE, IN PARTICULAR WATER SLIDE

The invention relates to a slide, in particular a water slide, with a take-off zone and a landing zone as well as a slide path extending therebetween with a slide surface which comprises several slide sections.

US 2005/0075180 A1 discloses a water slide which, starting from a take-off zone, comprises a run-up section followed by a slide reversal element comprising a first slide connector connected to the run-up section. Following the first slide connector, an uphill section is provided, through which the slide direction is reversed so that the sliding person is transferred to a second slide connector adjacent to the first slide connector in order to enter a subsequent slide section. This arrangement may be repeated several times until the sliding person enters a run-out section leading to the landing zone, starting from the last slide direction reversal element. At each slide reversal element, there is a change in the slide direction.

US 2002/0142851 A discloses a white-water slide in which one or more persons can experience a slide ride on a tyre. This slide comprises, starting from the take-off zone, a first run-up section which opens into a branching section. The branching section has a second slide connector adjacent to the first slide connector and a third slide connector opposite the first two. This third slide connector is elevated compared to the first and second slide connectors. If the sliding person enters the branching section with a low kinetic energy, he or she does not reach the elevated third slide connector, but slides in the opposite direction via the second slide connector into a further slide section. If the sliding person has sufficient kinetic energy, he or she can continue to slide feet first and enters a bonus section via the third slide connector, which leads into a subsequent second branching section. The second slide connector of the preceding branching section also opens into this second branching section. The sliding person can thus continue the slide either feet first or head first. In the run-out section, the sliding person enters the landing zone either head first or feet first, depending on the particular kinematic energy.

Entering the landing zone by a sliding person in a head-first sliding position creates a risk of injury as the sliding person cannot see if there are still people located in the landing zone.

The object of the invention is to propose a slide, in particular a water slide, by means of which a sliding person can pass through a slide path with a plurality of slide sections connected by branching sections, wherein the sliding directions in individual slide sections can deviate from one another and it is ensured, irrespective of the entrained kinematic energy of the sliding person, that the sliding person slides feet first into the landing zone.

This object is achieved by a slide in which a slide path with a plurality of slide sections is provided between a take-off zone and a landing zone, wherein two mutually associated branching sections or a plurality of branching sections mutually associated in pairs are provided in the slide path and the first branching section of the mutually associated branching sections in the slide path is connected to a run-up section leading away from the take-off zone or to a slide section leading to the branching section and having a first slide connector, and the second branching section of the mutually associated branching sections in the slide path is connected to the second slide connector to the run-out section or to a slide section leading away. The branching section comprises a first and second slide connector oriented adjacently to each other and a third slide connector opposite or remote therefrom, wherein the opposite or remote third slide connector is elevated relative to the first and second slide connector when viewed in the vertical direction. The first of the two mutually associated branching sections can transfer the sliding person into one of the two outgoing slide sections, which are connected to the second and third slide connector. These outgoing slide sections can be an alternative section or a bonus section. This same orientation is provided with respect to the first and second slide connector and the opposite third slide connector at the second of the mutually associated branching sections. Preferably, it is provided that at each of the first and second branching sections, the first slide connector is connected to an incoming slide section. The second slide connector of the first and second branching sections or of the two branching sections mutually associated in pairs is connected to an outgoing slide section in each case. An interchange in the connection of the slide section takes place with regard to the third slide connector. At the first branching section, the third slide connector is connected to an outgoing slide section, wherein this outgoing slide section becomes the incoming slide section and is connected to the second branching section in the third slide connector. The arrangement of the two mutually associated branching sections makes it possible for the sliding person, who leaves the take-off zone feet first and slides feet first into the run-up section leading away from the take-off zone, to enter the run-up section feet first after passing through the slide path comprising several slide sections, irrespective of whether a bonus section or an alternative section is passed through, and thereby to slide into the landing zone with a view of the landing zone. This allows for increased safety in such slides.

Insofar as further branching sections are provided between the first and last mutually associated branching sections within the slide, the arrangement of further branching sections provided in between requires that these are mutually associated in pairs, so that each two additional branching sections are oriented analogously to the two branching sections already provided. In this way, any number of slide sections with bonus section and alternative section can be formed, wherein again an orientation of the sliding person can be forced so that he or she slides feet first into the landing zone.

According to a preferred embodiment of the invention, it is provided that the branching section has a rectilinear continuous slide surface between the first and third slide connector or between the second and third slide connector. This may allow a preferred direction in terms of the slide direction through the branching sections. Alternatively, the branching section may have a Y-shaped course of the slide surface between the first and second slide connector and the opposite third slide connector.

According to an advantageous embodiment of the invention, it is provided that the first of the mutually associated branching sections is connected by the first slide connector to an incoming slide section and the second slide connector is connected to an outgoing slide section, in particular an alternative section, and the third slide connector is connected to a further outgoing slide section, in particular a bonus section. The bonus section differs from the alternative section in that a longer slide section is provided, possibly with additionally installed adventure elements. However, due to the ascending section from the mouth region of the branching section to the third slide connector, the sliding person needs to slide with a high kinetic energy in order to reach the bonus section.

The further branching section associated in a pair is preferably connected by the second slide connector to an outgoing slide section, and the first slide connector to an incoming slide section. This incoming slide section can be the end of the alternative section. The third slide connector is connected to an incoming slide section. This incoming slide section can be the end of the bonus section.

Furthermore, it is preferably provided that the two mutually associated branching sections are connected to each other by a slide section, in particular a bonus section, by the slide section arranged between the branching sections being connected on the one hand to the third slide connector of the first branching section and on the other hand to the third slide connector of the second branching section. In this way, it can be ensured that the sliding person slides feet first through both the first and the second branching section and thus enters the landing zone feet first.

In particular, it is provided that a bead-like elevation is provided between the first and second slide connectors of the branching section, which bead-like elevation decreases at least in the direction of the opposite third slide connector and preferably transitions into the slide surface in the mouth region of the branching section. This enables a controlled transfer of the sliding person from the entry into the branching section to the exit from the branching section via the various slide connectors.

Furthermore, it is preferably provided that the third slide connector is provided at the end of the ascending section and/or a superelevation or a crest. This enables the sliding person to slide over the elevation or crest only if there is sufficient kinetic energy, in order to then preferably enter a bonus section.

Furthermore, it is preferably provided that the branching section between the two adjacent first and second slide connectors and the opposite or remotely arranged third slide connector has a curved or arc-shaped course. This can provide a further enhancement of the experience.

In particular, it is provided that the third slide section is oriented at an angle of between 45° and 270°, preferably between 90° and 180°, with respect to the first and second slide connector, wherein the curved, curvilinear or arcuate or even elliptical course of the ascending section can be formed therebetween.

Advantageously, it is provided that the slide is designed as a body slide.

Furthermore, it is preferably provided that the slide is exposed to a water film, a water precipitation or spray mist. This makes it possible to achieve a sliding film between the slide surface and the sliding person. It is also possible that the sliding speed along the slide path can be controlled depending on the wetting of the slide surface.

The invention and other advantageous embodiments and developments thereof are described and explained in greater detail hereinafter with reference to the examples shown in the drawings. The features to be taken from the description and the drawings can be used individually or in any combination in accordance with the invention.

Figure 2:
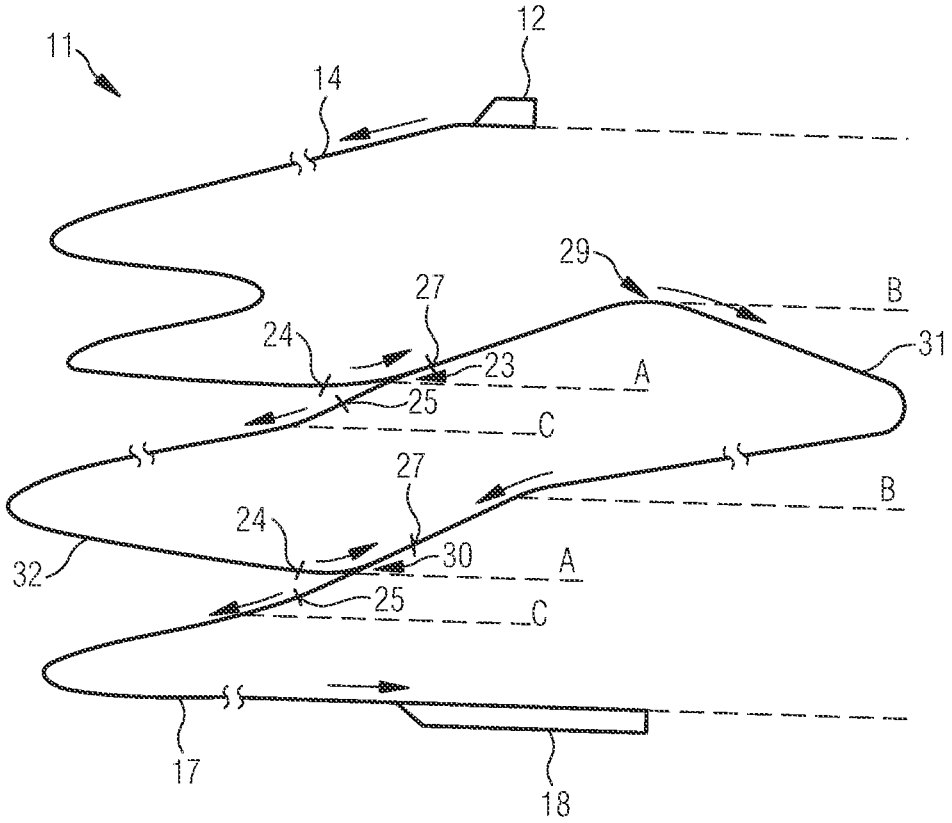
Figure 3:
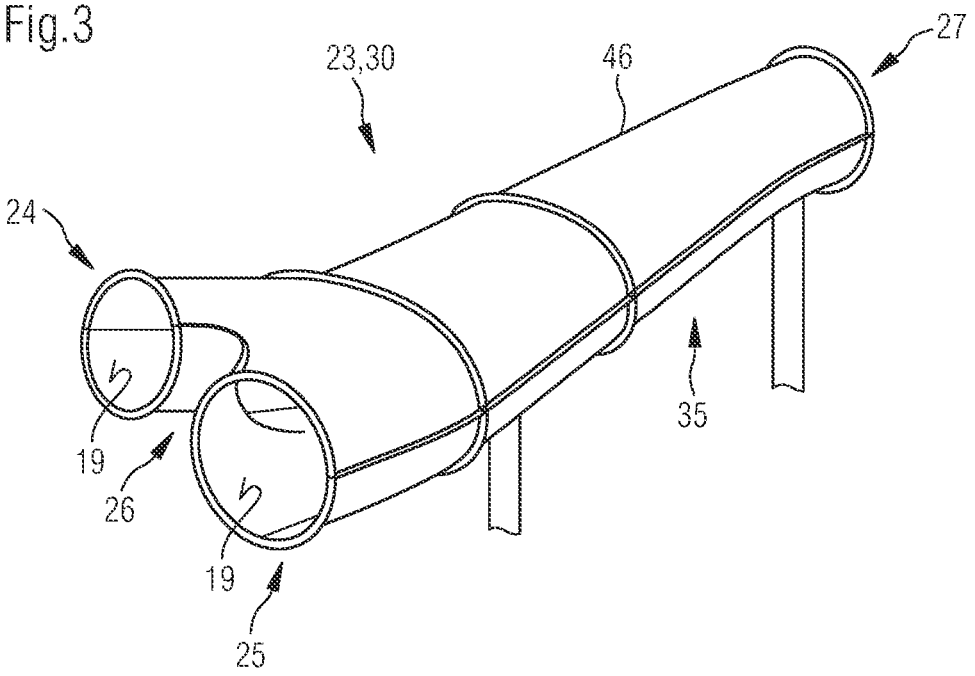
Figure 4:
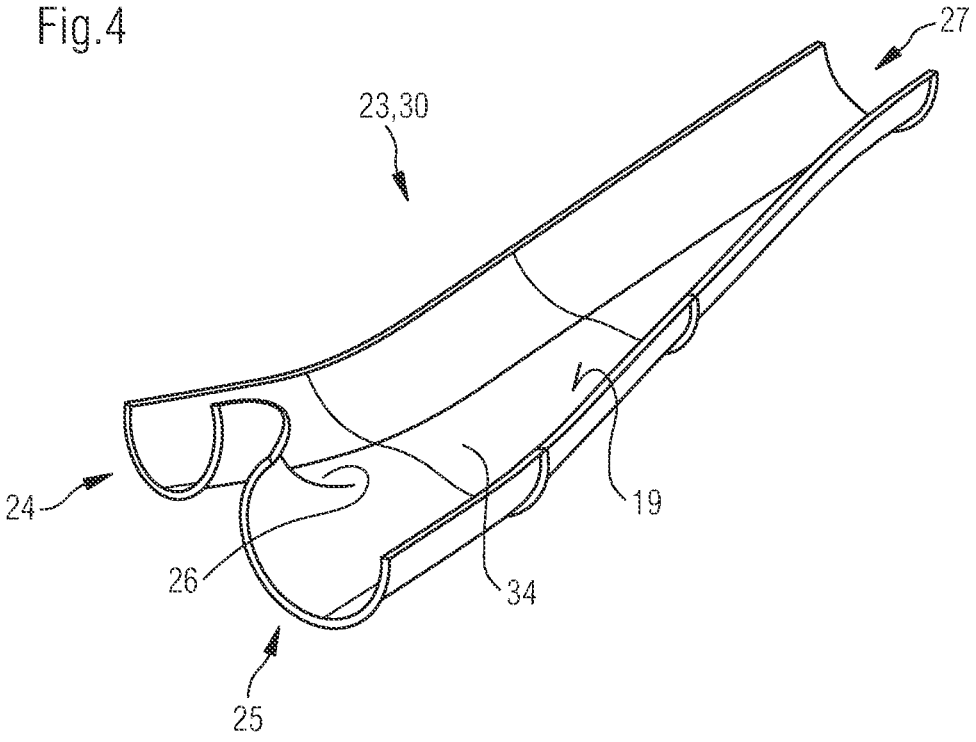
Figure 5:
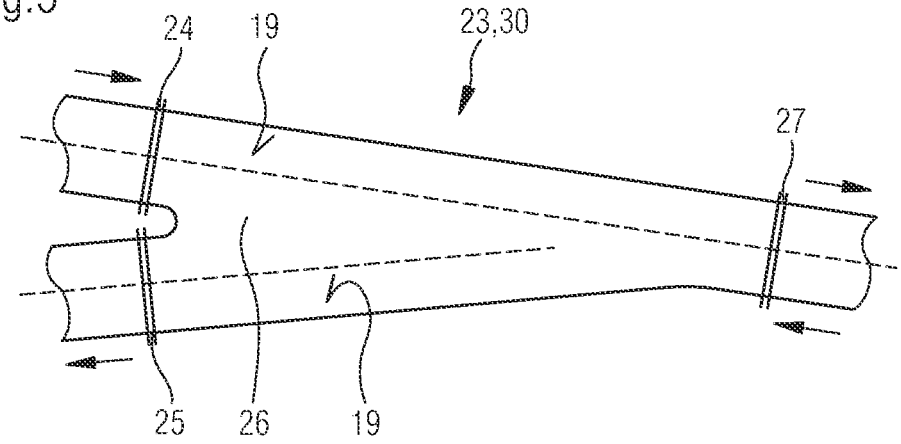
Figure 6:
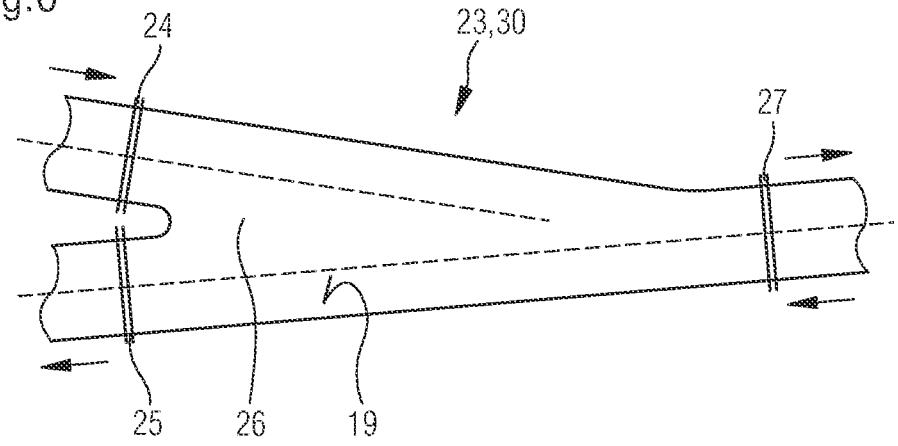
Figure 7:
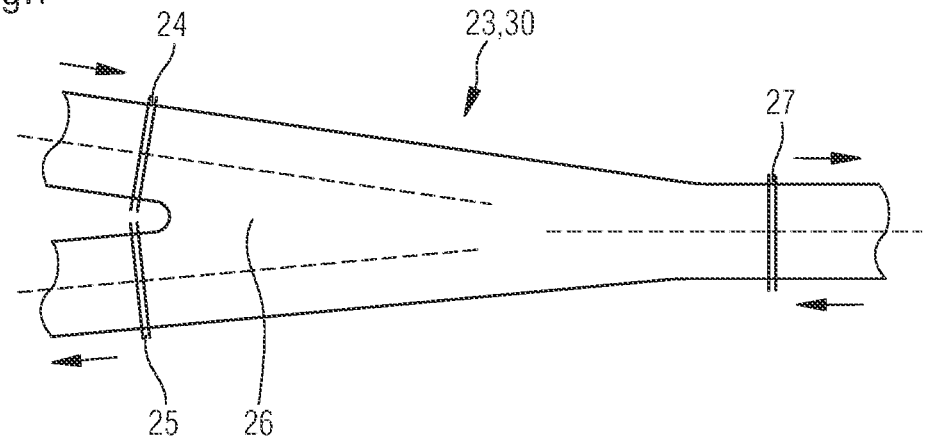
Figure 8:
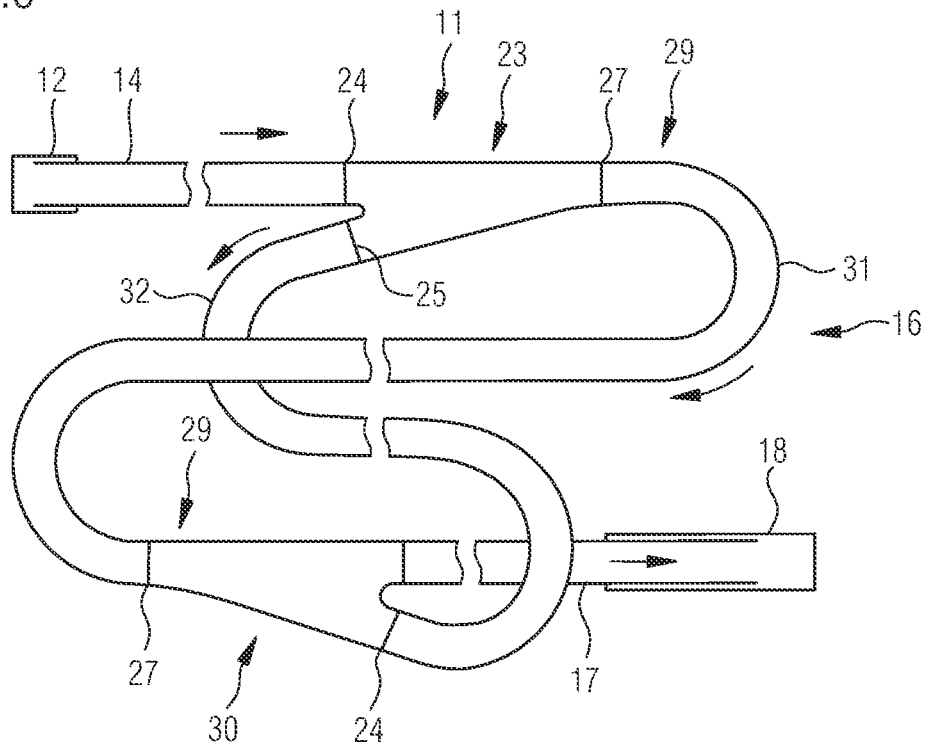
Figure 9:
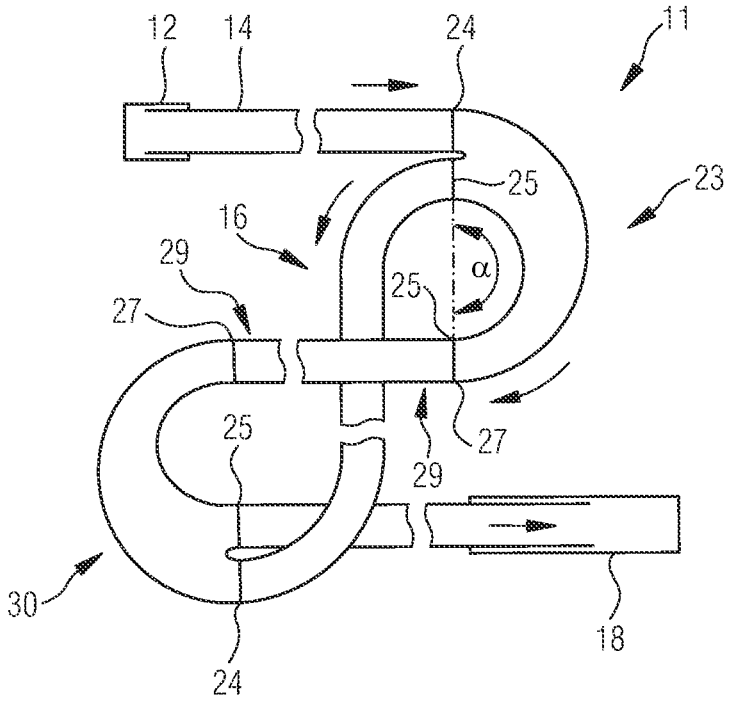

The drawings show:

FIG. 1 a schematic view of a slide,

FIG. 2 a schematic side view of the slide according to FIG. 1,

FIG. 3 a perspective view of a branching section,

FIG. 4 a perspective view of the branching section according to FIG. 3 in an open embodiment, FIG. 5 a schematic view from above of the embodiment according to FIG. 3, FIG. 6 a schematic view from above of the branching section according to an alternative embodiment to FIG. 5, FIG. 7 a schematic view from above of another alternative embodiment of the branching section, FIG. 8 a schematic view from above of an alternative course of the slide section of the slide to FIG. 1, and FIG. 9 a schematic view of a slide according to FIG. 1 with an alternative embodiment of a branching section.

FIG. 1 shows a schematic view from above of a slide 11, in particular a water slide. FIG. 2 shows a schematic side view of the slide 11 according to FIG. 1. This FIG. 2 shows a height profile of the slide 11. This slide 11 can be what is known as a dry slide, in which the sliding person slides directly along the slide surface or slides by means of a mat or carpet. In particular, the slide 11 is designed as a water slide, wherein the sliding person slides directly on a film of water on a slide surface 19 of the slide 11. This slide 11 may also be designed as a tyre slide, where-in the slide surface is limited in width such that only one person sitting on a tyre or two persons sitting on a double tyre one behind the other can slide along the slide path 11. A change of direction in the orientation of the sliding person along and within a slide section 21 is not possible. The slide 11 is not designed as a tyre slide in which one or more persons can slide along the slide path on a tyre and can rotate at will about the vertical axis of the tyre or the slide element during the slide ride.

The slide 11 comprises a take-off zone 12, in which the sliding person prepares for the slide ride. From the take-off zone 12, the sliding person enters a descending run-up section 14. In the take-off zone 12, the person aligns himself or herself feet first in order to enter the run-up section 14. The run-up section 14 forms part of a slide path 16, which ends in a run-out section 17. The run-out section 17 leads into a landing zone 18. This landing zone 18 can be a pool filled with water. This pool preferably has a low water level, so that on the one hand a gentle, safe landing is possible and on the other hand it is easy to leave the pool on foot.

The slide path 16 comprises slide sections 21 with a slide surface 19 (FIG. 3), which can be flat or curved or recessed transversely to the slide direction. The slide section 21 can be designed as a closed channel 46 or tube. Within the slide path 16, several different slide sections 21 can be provided so that the sliding person can slide through different slide routes between the take-off zone 12 and the landing zone 18 depending on his or her kinetic energy. This increases the fun and enhances the experience.

For example, following the run-up section 17, a slide section 21 can be provided which is curved or helical. This curved section can be, for example, 180°, 270°, 360° or a multiple thereof.

A branching section 23 is connected to the run-up section 14 or to the first slide section 21. This branching section 23 is shown schematically in an enlarged view in FIG. 3. The branching section 23, 30 shown in FIG. 3 is closed. FIG. 4 shows an alternative embodiment of the branching section 23, 30 according to FIG. 3, this time in an open design. A tube portion covering the slide surface 19 to form a closed tube or channel, as shown in FIG. 3, can also be omitted according to the embodiment in FIG. 4. This branching section 23 according to FIG. 3 comprises a first slide connector 24 and adjacent thereto a second slide connector 25. Opposite the first and second slide connector 24, 25, there is provided a third slide connector 27. This branching section 23 is what is known as a Y-branching section. Viewed vertically, the first slide connector 24 is located between the second slide connector 25 and the third slide connector 27. The third slide connector 27 is elevated relative to the first slide connector 24. Alternatively, it can be provided that the second slide connector 25 is elevated relative to the first slide connector 24.

The three slide connectors 24, 25, 27 form a mouth region 34 within the branching section 23. A bead-like elevation 26 is formed between the first and second slide connector 24, 25, which lowers in the direction of the mouth region 34 and preferably transitions into the slide surface 19 in the mouth region 34. Starting from the mouth region 34, an ascending section 35 follows in the direction of the third slide connector 27. This ascending section 35 can transition directly into the third slide connector 27. Alternatively, a crest 29 or an elevation can be formed between the ascending section 35 and the third slide connector 27. Thus, the slide connector 27 is provided slightly below an apex of the crest 29.

This branching section 23 according to FIG. 3 is integrated into the slide path 16 according to FIG. 1 in that the first slide connector 24 is connected to the run-up section 14 or an incoming slide section 21. The third slide connector 27 transitions into an outgoing slide section 21, in particular a bonus section 31. The second slide connector 25 transitions into a further outgoing slide section 21, in particular an alternative section 32. The bonus section 31 and the alternative section 32 are connected to a further branching section 30. The alternative section 32 is connected to the first slide connector 24 of the second branching section 30. The bonus section 31 is connected to the third slide connector 27 of the second branching section 30. Another slide section 21 leads from the second slide connector 25 of the second branching section 30 or is directly connected to the run-out section 17.

The first branching section 23 and the second branching section 30 can have the same design. This arrangement and orientation of the first branching section 23 and the second branching section 30 enables the sliding person, who enters the run-up section 14 feet first, to also enter the run-out section 17 and thus the landing zone 18 in a controlled manner, feet first.

This controlled orientation of the sliding person is independent of whether the sliding person enters the bonus section 31 or alternative section 32 from the first branching section 23. The second branching section 30 reverses the sliding direction that is caused by the first branching section 23 if the sliding person slides into the alternative section 32, again in the sliding direction in the second branching section 30, so that the sliding person slides feet first into the run-out section 17.

In order to illustrate two possible slide routes along the slide path 16, the arrangement and orientation of the branching sections 23, 30 will be explained once again with reference to FIG. 2. The position and height of the branching section 23 is oriented in such a way that the first slide connector 24, through which the sliding person enters, is at height A below the end of the ascending section 35 of the branching section 23 or the third slide connector 27. This is at height B. The second slide connector 25 is located at height C below the first slide connector 24. This results in two variants. The sliding person enters the first branching section 23 feet first with a high kinetic energy. In this case, this person slides feet first over the ascending section 35 and, as applicable, the crest 29 and reaches the third slide connector 27. Subsequently, the sliding person enters the bonus section 31 feet first.

If the kinetic energy of the person sliding feet first is not sufficiently high when entering the first slide connector 24 of the first branching section 23, this person slides backwards, or head first, into the second slide connector 25 and enters the alternative route 32 head first.

Irrespective of the kinetic energy of the sliding person in the alternative section 32, this person in turn enters the second branching section 30 via the first slide connector 24. Since the third slide connector 27 is elevated compared to the first slide connector 24, as is the bonus section 31 connected to it, the person sliding head first into the second branching section 30 then enters the second slide connector 25, which is connected to the outgoing slide section 21 or to the run-out section 17, feet first. The two mutually associated branching sections 23, 30 enable the orientation of the sliding person so that he or she arrives at the landing zone 18 feet first.

The sliding person, who has entered the bonus section 31 feet first, continues to slide through the second branching section 30 feet first and arrives at the outgoing slide section 21 or the run-out section 17 and feet first in the landing zone 18.

According to a further embodiment of the slide 11 in FIGS. 1 and 2, it may be provided that further slide elements can be provided between the first branching section 23 and the second branching section 30 or between the first and the last branching section 23, 30 in the slide 16. Provided that further bonus and alternative sections 31, 32 are planned, it is necessary that the further branching sections interposed between the first and second or between the first and the last branching section 23, 30 are likewise arranged in pairs and, moreover, are oriented in the same way. The controlled orientation of the sliding person can thus be achieved, so that when the person starts from the take-off zone 12 feet first, he or she also enters the landing zone 18 feet first.

FIG. 5 shows a schematic view of the branching section 23, 30 according to FIGS. 3 or 4. In this embodiment of the branching section 23, it is provided that a rectilinear course of the slide surface 19 is formed between the first slide connector 24 and the third slide connector 27. This means that there is a preferred direction between the first slide connector 24 and the third slide connector 27 when sliding through the branching section 23.

The bead-like elevation 26 is formed between the first and second slide connectors 24, 25, which ensures that when the sliding person enters via the first slide connector 24, if there is insufficient kinetic energy to reach the third slide connector 27, the branching section 23 is exited via the second slide connector 25.

FIG. 6 shows an alternative embodiment of FIG. 5. In this embodiment, the slide surface 19 is designed to run in a straight line between the second slide connector 25 and the third slide connector 27. Thus, the preferred direction for sliding through this branching section 23, 30 is between the second slide connector 25 and the third slide connector 27.

FIG. 7 shows another alternative embodiment of the branching section 23, 30 to FIGS. 5 and 6. The slide connectors 24, 25 open quasi identically into the branching sections 23, 30 and merge into a common slide surface 19, which leads to the third slide connector 27.

FIG. 8 shows a schematic view from above of an alternative embodiment of the slide 11 to FIG. 1. The structure of the slide 11 according to FIG. 8 corresponds to that according to FIGS. 1 and 2 with regard to the individual components, and therefore reference can be made to said figures. In the view from above of the slide course of the slide 11 according to FIG. 1, the branching sections 23, 30 are oriented for example in the same way, i.e. the slide connectors 24, 25 both point to the left and the slide connector 27 to the right. In the embodiment of the slide 11 according to FIG. 8, the orientation of the branching sections 23, 30 can also be opposite. This can be seen from the view from above of the slide 11 according to FIG. 8.

Both slides 11 have in common that in each case the third slide connector 27 of the branching sections 23, 30 are connected to a bonus section 31.

FIG. 9 shows a schematic view from above of a further alternative embodiment of the slide 11 to FIGS. 1 and 8. This embodiment differs in particular in that the contour or geometry of the branching sections 23, 30 is designed differently from that of the branching sections 23, 30 shown in FIGS. 1 and 8. In this embodiment, it is provided that the third slide connector 27 is oriented at an angle α of, for example, 180° to the first and second slide connectors 24, 25. A curved slide surface 19 or a curved slide surface 19 is formed therebetween. This angle a may have an angular range of 45 to 270°. As an alternative to the arcuate course of the slide section between the first and second slide connector 24, 25 and the third slide connector 27, a curved or elliptical course can also be provided. In this way, the courses of the individual slide sections can be designed in a variety of ways. Incidentally, the previous explanations also apply to this slide 11 as shown according to FIG. 9.

The slide sections 21 and/or the branching sections 23, 30 can be designed as closed tubes. These closed tubes can be made of plastic. These tubes can be made of opaque materials. Portions of the tubes that are transparent in part, in some sections or in full may also be provided.

REFERENCE NUMBERS

11. Slide
12. Take-off zone
14. Run-up area
16. Slide path
17. Run-out track
18. Landing zone
19. Slide section
21. Slide area
23. Branching section
24. First slide connector
25. Second slide connector
26. Bead-like elevation
27. Third slide connector
29. Crest
30. Second branching section
31. Bonus section
32. Alternative section
34. Mouth region
35. Ascending section
46. Channel

The invention claimed is:

1. Slide, in particular water slide, with a take-off zone and a landing zone, between which at least one slide path with a slide surface extends, which comprises a run-up section leading away from the take-off zone and a run-out section leading into the landing zone, with a plurality of slide sections of the slide path provided between the run-up section and the run-out section, with at least two branching sections arranged in the slide path, wherein at least one of the branching sections has an incoming slide section, which is divided into a plurality of outgoing slide sections, or has a plurality of incoming slide sections, which are merged into one outgoing slide section, wherein at least one of the branching sections has a first slide connector and a second slide connector adjacently thereto, both of which are opposite or remote from a third slide connector, and a merging region is formed between the first and second slide connector and the third slide connector, and the third slide connector is elevated relative to the first and second slide connector as viewed in the vertical direction, and an ascending section is formed starting from the mouth region in the direction of the third slide connector, wherein two mutually associated branching sections or a plurality of branching sections mutually associated in pairs are provided in the slide path, in that a first branching section of the mutually associated branching sections in the slide path is connected by the first slide connector to the run-up section or to the slide section leading to the first branching section, and in that a second branching section of the mutually associated branching sections in the slide path is connected by the second slide connector to the run-out section or to the slide section leading away from the second branching section.

2. Slide according to claim 1, wherein the branching section has a rectilinear continuous slide surface between the first and third slide connector or between the second and third slide connector.

3. Slide according to claim 1, wherein the branching section between the first and second slide connector and the opposite third slide connector has a Y-shaped course of the slide surface.

4. Slide according to claim 1, wherein the first branching section of the mutually associated branching sections is connected by the first slide connector to the incoming slide section and the second slide connector is connected to the outgoing slide section, and the third slide connector is connected to the further outgoing slide section.

5. Slide according to claim 4, wherein the outgoing slide section is an alternative section and the further outgoing slide section is a bonus section.

6. Slide according to claim 1, wherein the second branching section of the mutually associated branching sections is connected by the second slide connector to the outgoing slide section and the first slide connector is connected to the incoming slide section, and the third slide connector is connected to the incoming slide section.

7. Slide according to claim 6, wherein the first slide connector is connected to an alternative section and the third slide connector is connected to a bonus section.

8. Slide according to claim 1, wherein the two mutually associated branching sections are connected to one another by a slide section, and the slide section is connected to the third slide connector of the first branching section and to the third slide connector of the second branching section.

9. Slide according to claim 1, wherein the branching section between the first and second slide connector has a bead-like elevation which decreases in the direction of the third slide connector.

10. Slide according to claim 9, wherein the bead-like elevation transitions into the slide surface in the merging region of the branching section.

11. Slide according to claim 1, wherein a crest or elevation is provided between the ascending section and the third slide connector or after the slide connector in the slide section.

12. Slide according to claim 1, wherein at a curved, oval or arcuate course is provided between the adjacent first and second slide connector and the opposite third slide connector.

13. Slide according to claim 12, wherein the third slide connector is oriented at an angle of between 45° and 270°, with respect to the first and second slide connector.

14. Slide according to claim 1, wherein the slide path designed as a body slide.

15. Slide according to claim 1, wherein the slide is a water slide.

* * * * *